US010792924B2

(12) United States Patent
Hayashi

(10) Patent No.: US 10,792,924 B2
(45) Date of Patent: Oct. 6, 2020

(54) LIQUID SUPPLYING SYSTEM INCLUDING TANK, CARTRIDGE CONNECTABLE THERETO, AND DETECTOR FOR DETECTING LIQUID LEVEL IN THE TANK

(71) Applicant: BROTHER KOGYO KABUSHIKI KAISHA, Nagoya-shi, Aichi-ken (JP)

(72) Inventor: Masahiro Hayashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/297,911

(22) Filed: Mar. 11, 2019

(65) Prior Publication Data

US 2019/0299643 A1 Oct. 3, 2019

(30) Foreign Application Priority Data

Mar. 30, 2018 (JP) ..... 2018-067446

(51) Int. Cl.
*B41J 2/175* (2006.01)

(52) U.S. Cl.
CPC ..... *B41J 2/175* (2013.01); *B41J 2/17523* (2013.01); *B41J 2/17566* (2013.01); *B41J 2002/17573* (2013.01); *B41J 2002/17576* (2013.01)

(58) Field of Classification Search
CPC .... B41J 2/175; B41J 2/17523; B41J 2/17566; B41J 2002/17573; B41J 2002/17576
See application file for complete search history.

(56) References Cited

U.S. PATENT DOCUMENTS

2009/0201351 A1 8/2009 Shimizu et al.
2012/0249692 A1* 10/2012 Kanbe ..... B41J 2/175 347/86

FOREIGN PATENT DOCUMENTS

JP 2008-238792 A 10/2008

* cited by examiner

*Primary Examiner* — Justin Seo
(74) *Attorney, Agent, or Firm* — Merchant & Gould P.C.

(57) ABSTRACT

A liquid supplying system includes a cartridge having a first storage chamber, a tube to which the cartridge is connectable, a tank having a second storage chamber, and a detector. The liquid stored in the first storage chamber of the cartridge connected to the tube is introduced through an opening of the tube. The liquid introduced through the opening flows through a liquid passage of the tube. The tank includes an inlet port for introducing the liquid flowing through the liquid passage into the second storage chamber. The detector detects whether a level of liquid in the second storage chamber is at a predetermined position that is below the opening and above the inlet port. The second storage chamber has a horizontal cross-sectional area greater than a horizontal cross-sectional area of the liquid passage in a region above the predetermined position and below the opening in a vertical direction.

10 Claims, 7 Drawing Sheets

LIQUID SUPPLYING SYSTEM INCLUDING TANK, CARTRIDGE CONNECTABLE THERETO, AND DETECTOR FOR DETECTING LIQUID LEVEL IN THE TANK

CROSS REFERENCE TO RELATED APPLICATION

This application claims priority from Japanese Patent Application No. 2018-067446 filed on Mar. 30, 2018. The entire content of the priority application is incorporated herein by reference.

TECHNICAL FIELD

The present disclosure relates to a liquid supplying system in which liquid is circulated between a cartridge and a tank.

BACKGROUND

Japanese Patent Application Publication No. 2008-238792 discloses a liquid supplying system in which liquid is supplied from a cartridge to a tank by water head difference and then from the tank to a head (consuming device) configured to consume the liquid. In this system, an amount of liquid left in the cartridge is configured to be detected by a sensor detecting a sensor arm provided within the cartridge.

SUMMARY

In a conventional liquid supplying system using water head pressure for supplying liquid from a cartridge to a tank, an amount of liquid left in the tank is detected. In such conventional system, conceivably, when a residual amount of liquid in a tank is detected by a sensor, for example, an amount of liquid left in a cartridge may also be determined based on the detected residual amount of liquid in the tank.

However, in the above-described system, in accordance with the liquid supplied from the tank to a head, a liquid level in the tank may temporarily become lower than a liquid level in the cartridge. In this case, since the sensor detects the liquid level in the tank, the residual amount of liquid in the cartridge may be erroneously determined to be too little to be supplied to the tank even though a sufficient amount of liquid still remains in the cartridge. In other words, the residual amount of liquid in the cartridge may not be detected with accuracy.

In view of the foregoing, it is an object of the present disclosure to provide a liquid supplying system that can reduce errors in detection of a residual amount of liquid in a tank.

In order to attain the above and other objects, according to one aspect, the disclosure provides a liquid supplying system including a cartridge, a tube, a tank, and a detector. The cartridge includes a first storage chamber configured to store therein a liquid; and a first air communication port allowing the first storage chamber to communicate with an atmosphere. The cartridge is connectable to the tube. The tube has an opening through which the liquid stored in the first storage chamber of the cartridge connected to the tube is configured to be introduced. The tube defines a liquid passage through which the liquid introduced from the first storage chamber through the opening flows. The tank includes a second storage chamber, an inlet port, and a second air communication port. The second storage chamber is configured to store the liquid. The second storage chamber has an upper end positioned above the liquid passage, and a lower end positioned below the liquid passage. The liquid flowing through liquid passage from the first storage chamber of the cartridge connected to the tube is introduced into the second storage chamber through the inlet port. The opening of the tube is positioned above the inlet port. The second air communication port allows the second storage chamber to communicate with the atmosphere. The detector is configured to detect that a level of the liquid stored in the second storage chamber reaches a predetermined position in a vertical direction, the predetermined position being positioned below the opening and above the inlet port in the vertical direction. The second storage chamber has a horizontal cross-sectional area greater than a horizontal cross-sectional area of the liquid passage in a region above the predetermined position and below the opening in the vertical direction.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
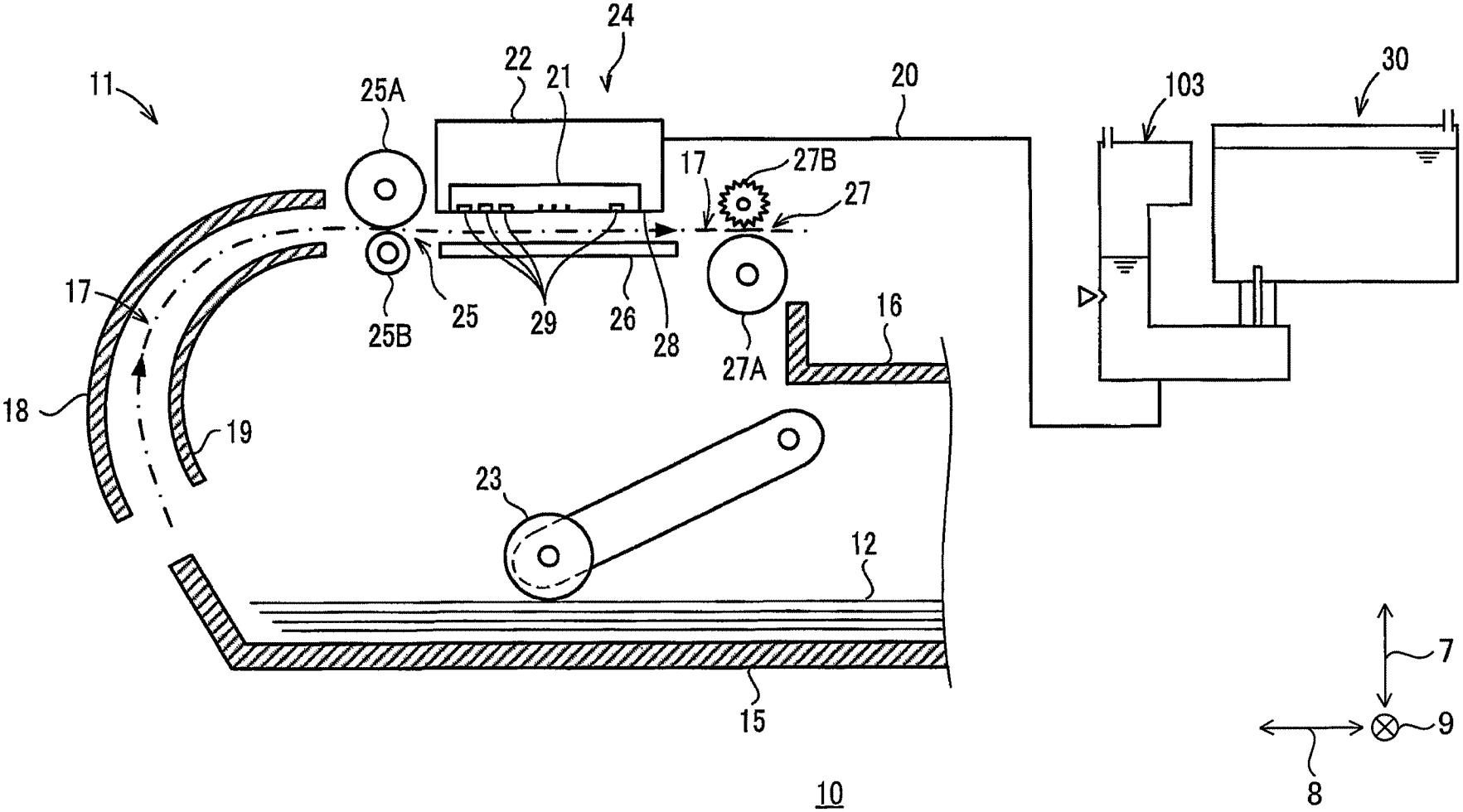
FIG. 1 is a vertical cross-sectional view schematically illustrating an internal configuration of a printer portion of a multifunction peripheral according to one embodiment.

A multifunction peripheral 10 as an example of a liquid supplying system according to one embodiment will be described with reference to the accompanying drawings, wherein like parts and components are designated by the same reference numerals to avoid duplicating description.

In the following description, up, down, front, rear, left, and right directions related to the multifunction peripheral 10 will be referred to assuming that the multifunction peripheral 10 is disposed on a horizontal plane so as to be operable, as shown in FIG. 1A. Note that this posture of the multifunction peripheral 10 illustrated in FIG. 1A will be referred to as an "operable posture". Specifically, an up-down direction 7 of the multifunction peripheral 10 is defined based on the operable posture of the multifunction peripheral 10. A front-rear direction 8 is defined assuming that a direction in which a sheet 12 is conveyed from a feed tray 15 of the multifunction peripheral 10 corresponds to a rearward direction. A left-right direction 9 is defined based on an assumption that the multifunction peripheral 10 in the operable posture is viewed from its front surface. In the drawings, a direction from a near side toward a far side in each drawing corresponds to a rightward direction.

In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 is perpendicular to the left-right direction 9.

[Overall Structure of Multifunction Peripheral 10]

The multifunction peripheral 10 includes a printer portion 11. The printer portion 11 is configured to record an image on each sheet 12 with an inkjet recording method. The multifunction peripheral 10 may also have other functions, such as a facsimile function, a scanning function, and a copying function.

As illustrated in FIG. 1, the printer portion 11 includes the feed tray 15, a discharge tray 16, a feed roller 23, a conveying roller pair 25, a discharge roller pair 27, a recording portion 24, and a platen 26.

<Feed Tray 15, Discharge Tray 16, and Feed Roller 23>

As illustrated in FIG. 1, the feeding tray 15 is configured to support a plurality of sheets 12 in a stacked state.

The discharge tray 16 is disposed above the feed tray 15. The discharge tray 16 is configured to support the sheets 12 discharged by the discharge roller pair 27 through a space between the recording portion 24 and the platen 26.

The feed roller 23 is driven by a feed motor (not illustrated) to feed each of the sheets 12 supported in the feed tray 15 toward a conveying path 17.

<Conveying Path 17>

The conveying path 17 is a space defined mainly by guide members 18, 19, the recording portion 24 and the platen 26. Inside the printer portion 11, the guide members 18 and 19 face each other with a predetermined interval, and the recording portion 24 and the platen 26 face each other with a predetermined gap therebetween. The conveying path 17 extends upward from a rear end portion of the feed tray 15, while making a U-turn toward the front, and passes through a position facing the recording portion 24, and reaches the discharge tray 16. A conveying direction of the sheet 12 along the conveying path 17 is indicated by a dashed-dotted arrow in FIG. 1.

<Conveying Roller Pair 25>

As illustrated in FIG. 1, the conveying roller pair 25 is disposed at the conveying path 17. The conveying roller pair 25 includes a conveying roller 25A and a pinch roller 25B arranged to oppose each other. The conveying roller 25A is configured to be driven by a conveying motor (not shown). The pinch roller 25B is configured to be rotated following rotation of the conveying roller 25A. As the conveying roller 25A is rotated forward in response to forward rotation of the conveying motor, each sheet 12 is nipped between the conveying roller 25A and the pinch roller 25B to be conveyed in the conveying direction.

<Discharge Roller Pair 27>

The discharge roller pair 27 is disposed at the conveying path 17 at a position downstream relative to the conveying roller pair 25 in the conveying direction. The discharge roller pair 27 include a discharge roller 27A and a spur roller 27B arranged to oppose each other. The discharge roller 27A is configured to be driven by the conveying motor (not illustrated). The spur roller 27B is configured to be rotated following rotation of the discharging roller 27A. When the discharge roller 27A is rotated forward in response to the forward rotation of the conveying motor, each sheet 12 is nipped between the discharge roller 27A and the spur roller 27B to be conveyed in the conveying direction.

<Recording Portion 24 and Platen 26>

As illustrated in FIG. 1, the recording portion 24 and the platen 26 are disposed at the conveying path 17 at a position between the conveying roller pair 25 and the discharge roller pair 27 in the conveying direction. Specifically, the recording portion 24 and the platen 26 are positioned downstream of the conveying roller pair 25 and upstream of the discharge roller pair 27 in the conveying direction. The recording portion 24 and the platen 26 are arranged to oppose each other in the up-down direction 7.

The recording portion 24 includes a carriage 22 and a recording head 21 mounted on the carriage 22. The carriage 22 is reciprocally movable in the left-right direction 9 upon transmission of driving force from a drive motor (not illustrated). The recording head 21 has a lower surface 28 at which a plurality of nozzles 29 are formed. The recording head 21 is configured to eject ink droplets through the nozzles 29 by oscillation of the nozzles 29 provided by oscillation elements such as piezoelectric elements. During lateral movements of the carriage 22, ink droplets are selectively ejected from the nozzles 29 onto the sheet 12 supported on the platen 26 to thus form an inked image on the sheet 12.

A bundle of ink tubes 20 and a flexible flat cable (not illustrated) are connected to the carriage 22. Each ink tube 20 connects each of four tanks 103 (described later) to the recording head 21. Specifically, each of the ink tubes 20 is configured to supply ink stored in a corresponding ink cartridge 30 attached to the tank 103 to the recording head 21. In the present embodiment, four ink tubes 20 are provided in one-to-one correspondence with four ink cartridges 30 attachable to the tanks 103, so that ink of four colors (black, magenta, cyan, and yellow) stored in the respective four ink cartridges 30 can flow through the corresponding ink tubes 20. These ink tubes 20 are bundled and connected to the recording head 21. The flexible flat cable is configured to electrically connect the recording head 21 to a control board (not illustrated) of the multifunction peripheral 10. The control board is configured to control operations of the multifunction peripheral 10.

<Tanks 103>

Each of the four tanks 103 is configured to store ink of one of four colors supplied from the corresponding one of the four ink cartridges 30.

In the following description, for simplifying description, only one of the four tanks 103 will be described in details, since the four tanks 103 have the same configurations as one another.

Figure 2:
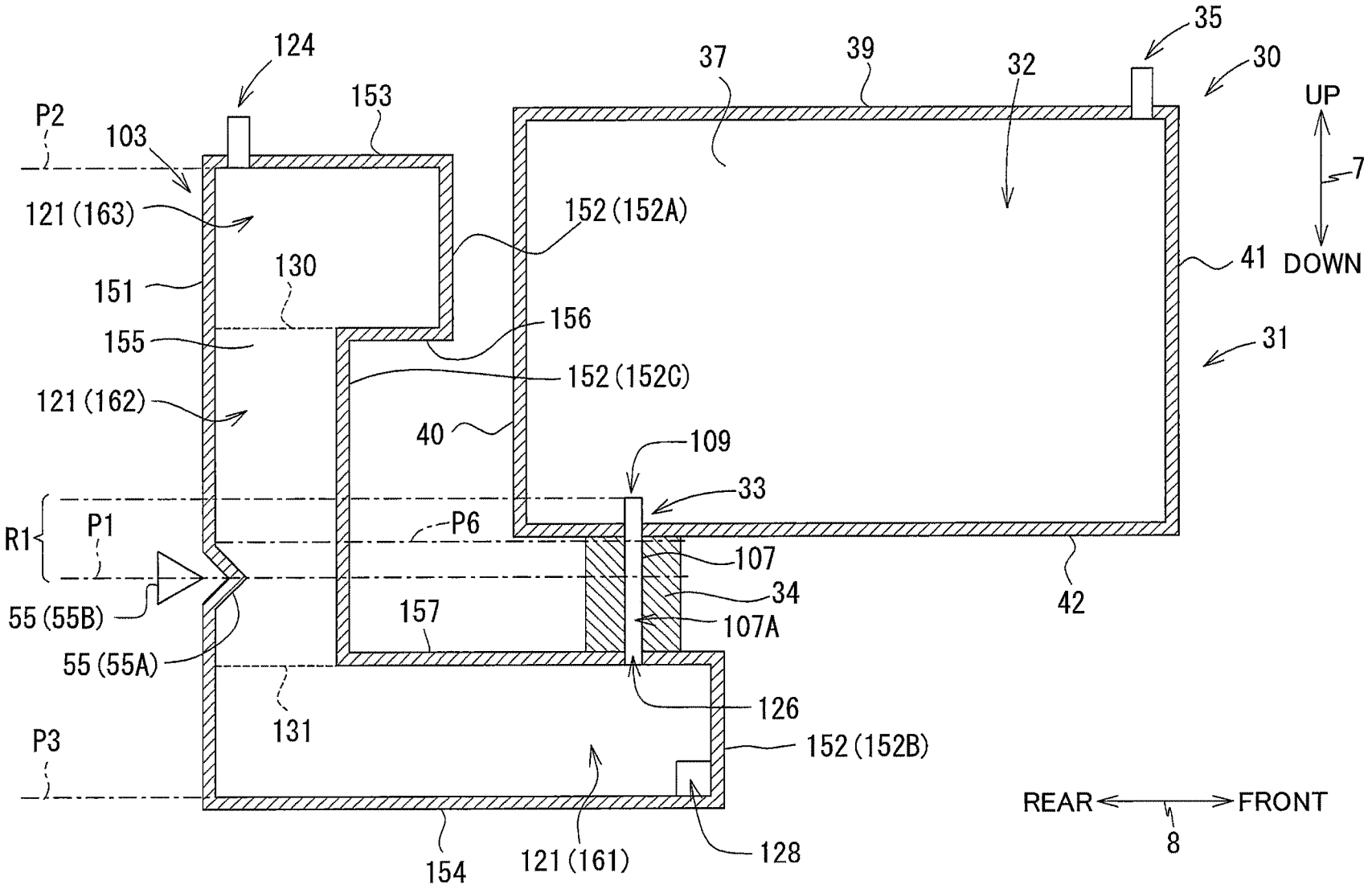
FIG. 2 is a vertical cross-sectional view schematically illustrating a state in which a cartridge and a tank of the printer portion according to the embodiment are connected to each other.

As illustrated in FIG. 2, the tank 103 has a box shape and defines therein a storage chamber 121 for storing ink. The tank 103 includes a rear wall 151, a front wall 152, an upper wall 153, a lower wall 154, step walls 156 and 157, and a pair of side walls 155 facing each other in the left-right direction 9.

The front wall 152 includes a first front wall 152A, a second front wall 152B, and a third front wall 152C. The first front wall 152A extends downward from a front end of the upper wall 153. The second front wall 152B is positioned lower than and frontward of the first front wall 152A. The second front wall 152B extends upward from a front end of the lower wall 154. The third front wall 152C is positioned between the first front wall 152A and the second front wall 152B in the up-down direction 7. The third front wall 152C is positioned rearward relative to the first front wall 152A and the second front wall 152B. The step wall 156 connects a lower end of the first front wall 152A and an upper end of the third front wall 152C. The step wall 157 connects an upper end of the second front wall 152B and a lower end of the third front wall 152C.

The storage chamber 121 is a space defined by the rear wall 151, the front wall 152 (first front wall 152A, second front wall 152B and third front wall 152C), the upper wall 153, the lower wall 154, the step walls 156 and 157, and the pair of side walls 155. The storage chamber 121 includes a first section 161, a second section 162, and a third section 163.

The first section 161 is a portion of the storage chamber 121 positioned below a broken line 131 depicted in FIG. 2. Specifically, the first section 161 is defined by a lower portion of the rear wall 151, the second front wall 152B, the step wall 157, the lower wall 154, and lower portions of the respective side walls 155.

The second section 162 is a portion of the storage chamber 121 positioned above the broken line 131 and below a broken line 130 depicted in FIG. 2. Specifically, the second section 162 is defined by a middle portion of the rear wall 151, the third front wall 152C, and middle portions of the respective side walls 155. The second section 162 is positioned above the first section 161.

The third section 163 is a portion of the storage chamber 121 positioned above the broken line 130 depicted in FIG. 2. Specifically, the third section 163 is defined by an upper portion of the rear wall 151, the first front wall 152A, the step wall 156, the upper wall 153 and upper portions of the respective side walls 155. The third section 163 is positioned above the second section 162.

The rear wall 151 and the third front wall 152C define a distance therebetween that is smaller than a distance defined between the rear wall 151 and the second front wall 152B in the front-rear direction 8. Hence, the second section 162 provides a horizontal cross-sectional area (i.e., an area of a virtual horizontal plane enclosed by the rear wall 151, the third front wall 152C, and the pair of side walls 155 as viewed in the up-down direction 7) that is smaller than a horizontal cross-sectional area of the first section 161 (i.e., an area of a virtual horizontal plane enclosed by the second front wall 152B, the rear wall 151 and the pair of side walls 155 as viewed in the up-down direction 7).

The rear wall 151 and the first front wall 152A define a distance therebetween that is greater than a distance defined between the rear wall 151 and the third front wall 152C in the front-rear direction 8. Hence, the third section 163 provides a horizontal cross-sectional area (i.e., an area of a virtual horizontal plane enclosed by the rear wall 151, the first front wall 152A, and the pair of side walls 155 as viewed in the up-down direction 7) that is smaller than the horizontal cross-sectional area of the second section 162.

The distance defined between the rear wall 151 and the second front wall 152B in the front-rear direction 8 is greater than the distance defined between the rear wall 151 and the first front wall 152A in the front-rear direction 8. Hence, the horizontal cross-sectional area of the first section 161 is greater than the horizontal cross-sectional area of the third section 163.

The first section 161 of the storage chamber 121 is in communication with the corresponding ink tube 20 through an outlet port 128. The outlet port 128 is provided in the vicinity of the lower wall 154 that defines a bottom edge of the storage chamber 121. The outlet port 128 is positioned below a connecting pipe 107 (described later). Ink stored in the storage chamber 121 flows out through the outlet port 128 and is supplied to the recording head 21 through the corresponding ink tube 20.

The upper wall 153 is formed with a communication port 124. The communication port 124 penetrates through the upper wall 153 in the up-down direction 7. The communication port 124 provides communication between the third section 163 of the storage chamber 121 and the outside of the tank 103 (atmosphere). Incidentally, the communication port 124 may be sealed by a semipermeable membrane.

The rear wall 151 has a portion 55A that faces a light emitter 55B of a liquid-level sensor 55 (described later) in the front-rear direction 8. Of the walls constituting the tank 103, this portion 55A of the rear wall 151 is at least light transmissive so that light emitted from the light emitter 55B can pass through the portion 55A. This portion 55A of the rear wall 151 serves as a prism 55A constituting the liquid-level sensor 55.

<Connecting Pipe 107>

As depicted in FIG. 2, the connecting pipe 107 is also provided at the tank 103. The connecting pipe 107 extends upward from the step wall 157. That is, the connecting pipe 107 extends in the front-rear direction 8. The connecting pipe 107 is arranged at a position corresponding to a position of an ink supply portion 34 (described later) of the ink cartridge 30 mounted in the multifunction peripheral 10.

The connecting pipe 107 is a tubular member made of a resin. The connecting pipe 107 defines an internal space 107A therein. The connecting pipe 107 has a protruding end (upper end) formed with an opening 109 in communication with the internal space 107A. An inlet port 126 is also formed in the step wall 157. The inlet port 126 is positioned higher than the outlet port 128, but lower than the opening 109 in the up-down direction 7. The inlet port 126 provides communication between the internal space 107A of the connecting pipe 107 and the first section 161 of the storage chamber 121.

Here, referring to FIG. 2, a predetermined range R1 is defined as a range below the opening 109 and above a predetermined position P1 (described later). In this predetermined range R1, the horizontal cross-sectional area of the second section 162 of the storage chamber 121 is greater than a horizontal cross-sectional area of the internal space 107A (an area of a virtual horizontal plane enclosed by an inner peripheral surface of the connecting pipe 107 as viewed in the up-down direction 7). Further, the internal space 107A is located below an upper end P2 of the storage chamber 121 but higher than a lower end P3 of the storage chamber 121 in the up-down direction 7.

<Liquid-Level Sensor 55>

The liquid-level sensor 55 is configured to detect whether a level of ink stored in the storage chamber 121 reaches the predetermined position P1 (indicated in FIG. 2). The liquid-level sensor 55 makes use of the prism 55A which provides an optical reflectivity that varies depending on whether the ink in the storage chamber 121 is in contact with the prism 55A.

As illustrated in FIG. 2, the predetermined position P1 is below the opening 109 of the connecting pipe 107 and above the inlet port 126 in the up-down direction 7. In the present embodiment, the predetermined position P1 is positioned within the second section 162 of the storage chamber 121 in the tank 103 in the up-down direction 7. Accordingly, the liquid-level sensor 55 is configured to detect the level of the ink stored in the second section 162 of the storage chamber 121.

The liquid-level sensor 55 includes the prism 55A, the light emitter 55B, and a light receiver (not illustrated). In the rear wall 151 defining the second section 162 of the storage chamber 121, a portion positioned at and in the vicinity of the predetermined position P1 constitutes the prism 55A. The light emitter 55B and the light receiver are positioned rearward of the prism 55A to face the prism 55A in the front-rear direction 8. The light emitter 55B is configured to emit light toward the prism 55A. The light receiver is configured to receive the light emitted from the light emitter 55B and then reflected by the prism 55A. The light receiver is configured to output a signal based on an intensity of the received light to the control board (not illustrated) of the multifunction peripheral 10.

When the level of the ink stored in the storage chamber 121 is above the predetermined position P1, the ink is in contact with the prism 55A on a path of the light emitted from the light emitter 55B. In this situation, the light emitted from the light emitter 55B to the prism 55A enters the storage chamber 121 through the prism 55A and is absorbed by the ink in the storage chamber 121 without being reflected by the prism 55A. The light emitted from the light emitter 55B thus does not reach the light receiver. Accordingly, the light receiver outputs a low-level signal to the control board of the multifunction peripheral 10. On the other hand, when the level of the ink stored in the storage chamber 121 is at or below the predetermined position P1, the ink is not in contact with the prism 55A on the path of the light emitted from the light emitter 55B. In this situation, the light emitted from the light emitter 55B to the prism 55A is reflected by the prism 55A and is received by the light receiver. The light receiver hence outputs a high-level signal to the control board of the multifunction peripheral 10.

Upon receipt of the high-level signal from the liquid-level sensor 55 after receiving the low-level signal, the control board (or a controller mounted on the control board) may issue a notification that ink stored in the ink cartridge 30 can no longer be supplied to the tank 103, for example. The notification may be made, for example, by means of displaying a warning message on a display of the multifunction peripheral 10. In this way, the control board is configured to determine whether the ink stored in the ink cartridge 30 can still be supplied to the tank 103 on a basis of a residual amount of ink in the storage chamber 121 of the tank 103.

[Ink Cartridge 30]

The ink cartridge 30 is a container storing ink therein. As depicted in FIG. 2, the ink cartridge 30 includes a housing 31 and the ink supply portion 34. The housing 31 has a substantially rectangular parallelepiped shape. Note that the ink cartridges 30 storing ink of different colors may have the same outer shape as one another, or may have different outer shapes from one another.

The housing 31 includes a rear wall 40, a front wall 41, an upper wall 39, a lower wall 42, and a pair of side walls 37 facing each other in the left-right direction 9. The housing 31 defines an internal space therein. This internal space of the housing 31 serves as a storage chamber 32 for storing ink therein.

The ink supply portion 34 protrudes downward from the lower wall 42 at a position near a rear end thereof. The ink supply portion 34 has a hollow cylindrical shape. The ink supply portion 34 has an internal space therein that is in communication with the storage chamber 32 through an outlet port 33 formed in the lower wall 42. The outlet port 33 penetrates through the lower wall 42 in the up-down direction 7. The ink supply portion 34 has a protruding end (open lower end) that is open to the outside of the ink cartridge 30. Although not illustrated in the drawings, the open protruding end of the ink supply portion 34 may be closed by a seal or a valve so that the protruding end can be opened when the ink cartridge 30 is used.

The upper wall 39 is formed with a communication port 35. The communication port 35 penetrates through the upper wall 39 of the housing 31 in the up-down direction 7. The communication port 35 provides communication between the storage chamber 32 and the outside of the ink cartridge 30 (atmosphere). The communication port 35 may be sealed with a semipermeable membrane.

As depicted in FIG. 2, the ink cartridge 30 is connectable to the corresponding tank 103 from above. In particular, the connecting pipe 107 of the tank 103 is inserted into the internal space of the ink supply portion 34 of the ink cartridge 30 from below so that the ink supply portion 34 of the ink cartridge 30 is connected to the connecting pipe 107 of the tank 103. The ink cartridge 30 is thus connected to the connecting pipe 107 in the up-down direction 7.

In a state where the ink cartridge 30 is connected to the tank 103, ink stored in the storage chamber 32 flows out from the storage chamber 32 of the ink cartridge 30 into the internal space 107A of the connecting pipe 107 of the tank 103 via the opening 109 of the connecting pipe 107. The ink circulates downward in the internal space 107A and flows into the first section 161 of the storage chamber 121 of the tank 103 through the inlet port 126. In this way, in the state where the ink cartridge 30 and the tank 103 are connected to each other, ink can circulate between the storage chamber 32 of the ink cartridge 30 and the storage chamber 121 of the tank 103 via the internal space 107A of the connecting pipe 107.

The posture of the multifunction peripheral 10 depicted in FIG. 2 is the operable posture. The multifunction peripheral 10 is configured to perform various operations such as image recording operations in the operable posture. Hereinafter, descriptions will be given on how ink stored in the storage chamber 32 and the storage chamber 121 is consumed as image-recording operations are executed and on how the liquid-level sensor 55 performs the ink level detection.

In the state where the ink cartridge 30 is mounted in a cartridge receiving portion (not shown) of the multifunction peripheral 10 and is connected to the tank 103, as depicted in FIG. 2, circulation of ink is allowed between the storage chamber 32 of the ink cartridge 30 and the storage chamber 121 of the tank 103. Hence, due to water head difference, the level of ink stored in the storage chamber 32 of the ink cartridge 30 is equalized to the level of the ink stored in the storage chamber 121 of the tank 103.

As an image recording operation is initiated, the ink stored in the storage chambers 32 and 121 flows out therefrom into the recording head 21 via the outlet port 128. Note that, at this time, an amount of ink that flows out of the storage chamber 32 is not necessarily equal to an amount of ink that flows out of the storage chamber 121. Hence, the liquid level in either one of the storage chambers 32 and 121 may temporarily become lower than the liquid level in the other one of the storage chambers 32 and 121. However, as time elapses, the liquid level in the storage chamber 32 and the liquid level in the storage chamber 121 eventually become equal to each other due to the water head difference. In this way, the liquid level in the storage chamber 32 and the liquid level in the storage chamber 121 both decline as the ink is consumed by the recording portion 24 through image recording operations. As a result, the lowered liquid surface comes to a position P6 indicated by a dashed-dotted line in FIG. 2. At this position P6, the liquid surface is positioned in the internal space 107A of the connecting pipe 107 and in the second section 162 of the storage chamber 121.

When an image recording operation is performed with the liquid level at the position P6, the ink stored in the storage chambers 32 and 121 is consumed. When the liquid level in the second section 162 of the storage chamber 121 decreases through the ink consumption and reaches the predetermined position P1, the liquid-level sensor 55 outputs a high-level signal to the control board. Upon receiving this high-level signal from the liquid-level sensor 55, the control board (the controller mounted on the control board) notifies the user that ink can no longer be supplied to the tank 103 from the storage chamber 32 of the ink cartridge 30 (cartridge empty).

Here, the position P6 is higher than the predetermined position P1 and lower than the opening 109 in the up-down direction 7. At this position P6, the horizontal cross-sectional area of the second section 162 is greater than the horizontal cross-sectional area of the internal space 107A of the connecting pipe 107. Therefore, the liquid level in the second section 162 is less likely to decrease, compared to the liquid level in the internal space 107A of the connecting pipe 107. That is, the liquid level in the internal space 107A of the connecting pipe 107 is easier to decrease than the liquid level in the second section 162 does. Hence, in a state where the liquid level in the second section 162 reaches the predetermined position P1, it is highly likely that the liquid level in the internal space 107A is lower than the predetermined position P1. Specifically, when the user is notified of the cartridge empty, it is highly likely that the ink can no longer be supplied to the tank 103 from the storage chamber 32 of the ink cartridge 30.

[Operational and Technical Advantages of the Embodiment]

In the present embodiment, the liquid-level sensor 55 detects the liquid level in the storage chamber 121 based on the predetermined position P1. This predetermined position P1 is lower than the opening 109 of the connecting pipe 107 and higher than the inlet port 126 of the tank 103. In other words, the predetermined position P1 is located within the internal space 107A of the connecting pipe 107. Hence, in a state where the liquid level is lowered to the predetermined position P1 and detected by the liquid-level sensor 55 as the ink flows out from the storage chamber 121, the surface of the liquid (ink surface) are positioned in the storage chamber 121 and in the internal space 107A.

Here, in the predetermined range R1 higher than the predetermined position P1 and lower than the opening 109 of the connecting pipe 107, the horizontal cross-sectional area of the storage chamber 121 is greater than the horizontal cross-sectional area of the internal space 107A of the connecting pipe 107. Therefore, the liquid level in the storage chamber 121 is less likely to decrease as long as the liquid level is located in the storage chamber 121 and the internal space 107A. That is, in the state where the liquid level reaches the predetermined position P1 and is detected by the liquid-level sensor 55, it is highly likely that the storage chamber 32 may have little ink that can be supplied to the storage chamber 121. In other words, this configuration of the embodiment can reduce a likelihood that the amount of ink left in the storage chamber 32 may be erroneously determined to be too little so that ink can no longer be supplied to the storage chamber 121 despite of the fact that a sufficient amount of ink still remains in the storage chamber 32.

According to the present embodiment, the internal space 107A of the connecting pipe 107 extends in the up-down direction 7 at and around the predetermined position P1 in the up-down direction 7. Hence, the liquid level in the internal space 107A can change easily. This structure can equalize the liquid level in the internal space 107A and the liquid level in the storage chamber 121 due to water head difference in a shorter period of time, than otherwise.

Further, according to the present embodiment, a large amount of ink still remains in the first section 161 of the storage chamber 121 even after ink supply from the storage chamber 32 of the ink cartridge 30 to the storage chamber 121 of the tank 103 is ceased. Thus, the ink left in the first section 161 can be supplied to the recording portion 24 for image recording operations.

Further, the predetermined position P1 is located not in the first section 161 but in the second section 162, and the horizontal cross-sectional area of the second section 162 is smaller than the horizontal cross-sectional area of the first section 161. In other words, the liquid-level sensor 55 detects the liquid level in the second section 162 having a smaller horizontal sectional-sectional area. Therefore, as compared to a case where the predetermined position P1 is in the first section 161, an enhanced detection accuracy can be achieved by the liquid-level sensor 55.

Further, the storage chamber 121 of the embodiment includes the third section 163, in addition to the first section 161 and second section 162. Thus, a larger amount of ink can be stored in the storage chamber 121 than otherwise.

According to the configuration of the present embodiment, the outlet port 128 is located lower than the inlet port 126. Therefore, even after ink supply from the storage chamber 32 of the ink cartridge 30 to the storage chamber 121 of the tank 103 through the inlet port 126 is ceased, ink available in a portion below the inlet port 126 and above the outlet port 128 in the storage chamber 121 can be supplied to the recording portion 24.

Further, the connecting pipe 107 of the embodiment extends in the up-down direction 7. The liquid level in the internal space 107A of the connecting pipe 107 is thus easy to change. This structure can shorten a period of time required for the liquid level in the internal space 107A and the liquid level in the storage chamber 121 to become equal to each other due to water head difference.

[Modifications and Variations]

While the description has been made in detail with reference to the embodiment thereof, it would be apparent to those skilled in the art that many modifications and variations may be made therein without departing from the scope of the disclosure.

<First Modification>

In the embodiment, the liquid-level sensor 55 is an optical sensor using the prism 55A. However, other well-known configurations may be available to detect the level of ink stored in the storage chamber 121 of the tank 103.

Figure 3:
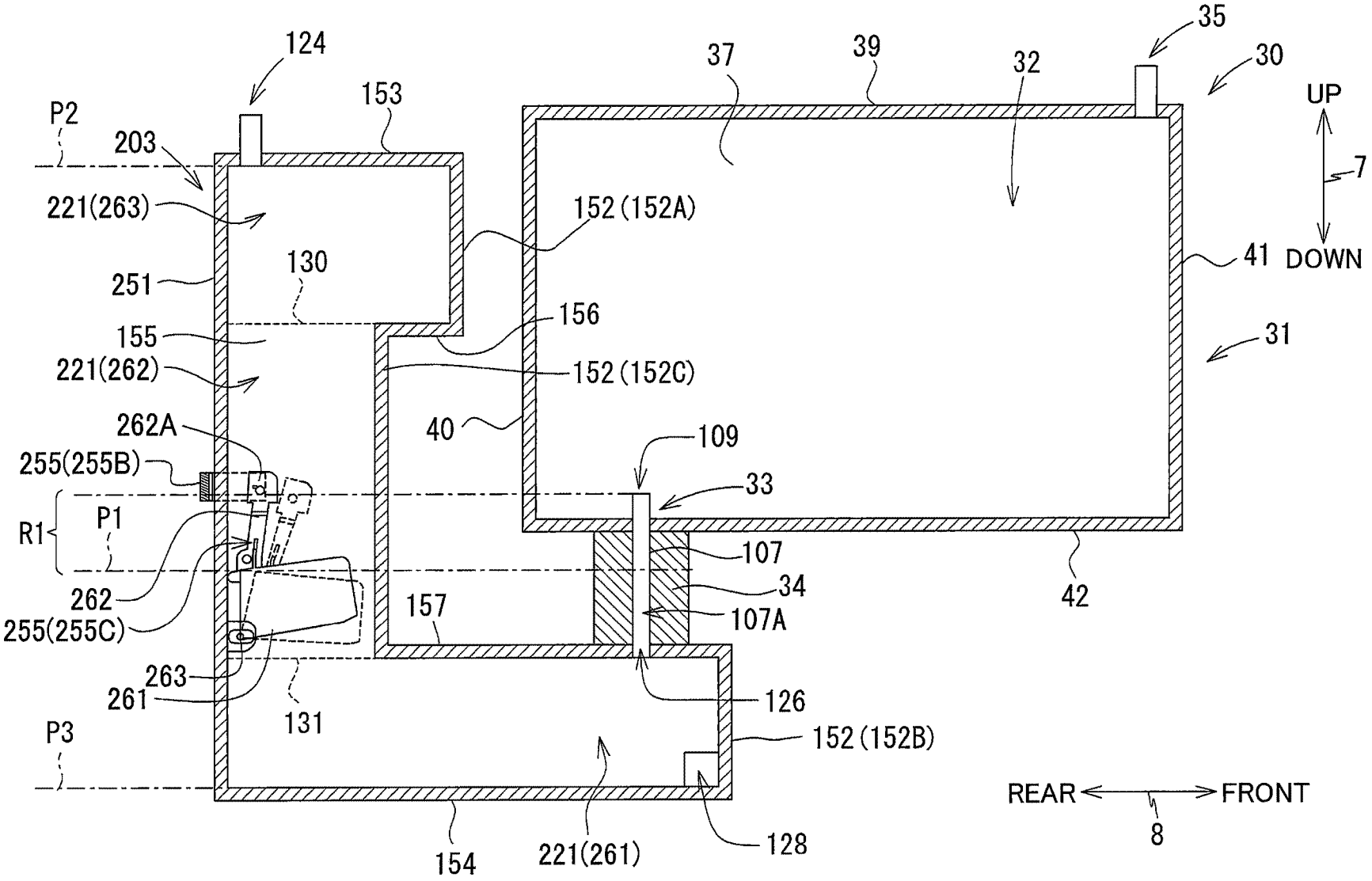
FIG. 3 is a vertical cross-sectional view schematically illustrating a state in which a cartridge and a tank according to a first modification to the embodiment are connected to each other.

FIG. 3 depicts a tank 203 according to a first modification to the embodiment. The tank 203 defines a storage chamber 221 configured of a first section 261, a second section 262 and a third section 263, as in the first embodiment. The tank 203 includes a liquid-level sensor 255, instead of the liquid-level sensor 55 of the embodiment. That is, the tank 203 includes a rear wall 251 without a portion serving as the prism 55A, instead of the rear wall 151.

Specifically, the liquid-level sensor 255 includes a detection member 255C disposed in the storage chamber 121, a light emitter 255B, and a light receiver (not illustrated).

The detection member 255C includes a float 261 and an arm 262. The float 261 has a specific gravity smaller than that of the ink stored in the storage chamber 121. Therefore, in the storage chamber 221, buoyancy acts on the float 261 as long as the float 261 is immersed in the ink. The arm 262 extends upward from the float 261. The arm 262 includes a tip end portion 262A having a plate shape. The detection member 255C is supported by the tank 203 such that the detection member 255C can pivot about an axis of a pivot shaft 263 provided at a lower portion of the detection member 255C.

The light emitter 255B and the light receiver are arranged to oppose each other with the tank 203 interposed therebetween in the left-right direction 9. The light emitter 255B is configured to emit light toward the light receiver. The light receiver is configured to receive the light emitted from the light emitter 255B and output a signal corresponding to an intensity of the received light to the control board (not shown) of the multifunction peripheral 10. Incidentally, a distance between the light emitter 255B and the light receiver in the left-right direction 9 may be made smaller in order to ensure that the light from the light emitter 255B reaches the light receiver. Hence, a left-right dimension of a portion of the tank 203 between the light emitter 255B and the light receiver may be made smaller than a left-right dimension of a remaining portion of the tank 203.

When the level of the ink stored in the storage chamber 221 is higher than the predetermined position P1, the detection member 255C is at a first position indicated by a solid line in FIG. 3, due to the buoyancy acting on the float 261. At the first position, the tip end portion 262A of the arm 262 of the detection member 255C is positioned between the light emitter 255B and the light receiver in the left-right direction 9. That is, the tip end portion 262A of the arm 262 is in an optical path of the light emitted by the light emitter 255B. Therefore, the light emitted from the light emitter 255B is blocked by the tip end portion 262A of the arm 262 and is not received by the light receiver. Accordingly, the light receiver outputs a low-level signal to the control board (not shown).

When the level of the ink stored in the storage chamber 221 falls down to or below the predetermined position P1, the float 261 moves downward along with the surface of the ink. The detection member 255C thus pivots from the first position to a second position indicated by a dashed line in FIG. 3. At the second position, the tip end portion 262A of the arm 262 is retracted from the position between the light emitter 255B and the light receiver in the left-right direction 9. That is, the tip end portion 262A of the arm 262 is offset from the optical path of the light emitted by the light emitter 255B. Therefore, the light emitted from the light emitter 255B is received by the light receiver. Hence, the light receiver outputs a high-level signal to the control board (not shown).

Alternatively, the light emitted from the light emitter 255B may be configured to pass through the detection member 255C to be received by the light receiver when the detection member 255C is at the first position; and the light emitted from the light emitter 255B may be absorbed by the ink stored in the storage chamber 221 so as not to be received by the light receiver when the detection member 255C is at the second position.

Still alternatively, instead of the liquid-level sensor 55 of the embodiment, electrode bars inserted in the storage chamber 221 may be used. In this case, two electrode bars may be mounted on a substrate (not illustrated) and disposed in the storage chamber 221. A lower end of one of the two electrode bars is located slightly higher than the predetermined position P1, while a lower end of the other electrode bar is arranged below the predetermined position P1. The control board of the multifunction peripheral 10 may determine whether the level of the ink stored in the storage chamber 221 is equal to or lower than the predetermined position P1 based on whether a current flows between the two electrode bars through the ink.

<Second Modification>

The configuration of the tank 103 is not limited to the one illustrated in FIG. 2. The tank 103 may have a variety of configurations as described below, provided that: the upper end of the storage chamber 121 (P2) is higher than the internal space 107A of the connecting pipe 107 and the lower end of the storage chamber 121 (P3) is lower than the internal space 107A of the connecting pipe 107; and the horizontal cross-sectional area of the storage chamber 121 is greater than the horizontal cross-sectional area of the internal space 107A in the predetermined range R1 (higher than the predetermined position P1 and lower than the opening 109).

For example, unlike the embodiment, the connecting pipe 107 of the tank 103 may not necessarily extend in the up-down direction 7, but may extend in a direction other than the up-down direction 7. For example, the connecting pipe 107 may extend in a direction crossing the up-down direction 7. Likewise, while the ink cartridge 30 of the embodiment is connected to the connecting pipe 107 in the up-down direction 7, the ink cartridge 30 may be connected to the connecting pipe 107 in a direction different from the up-down direction 7 (for example, in the front-rear direction 8).

Figure 4:
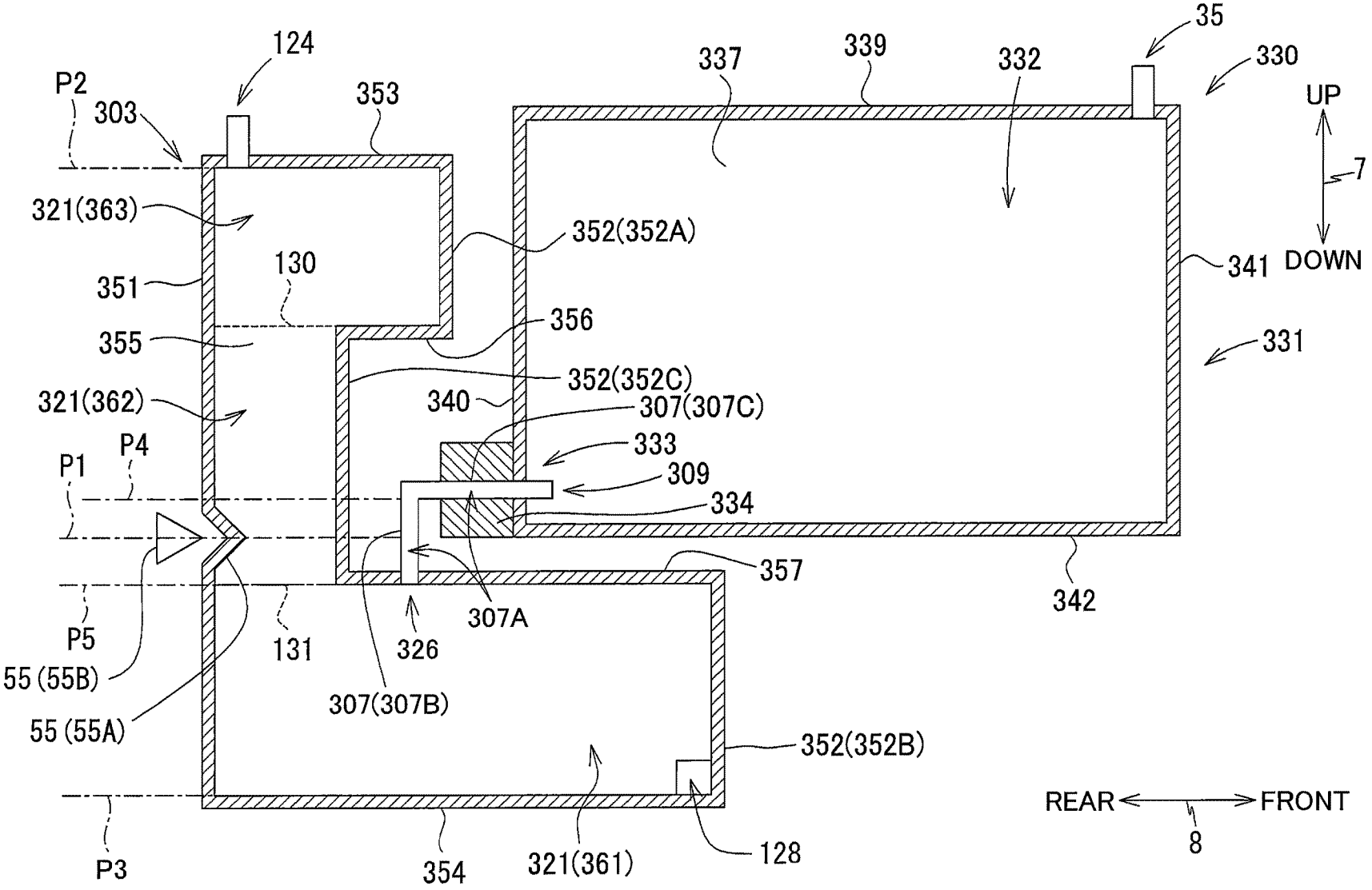
FIG. 4 is a vertical cross-sectional view schematically illustrating a state in which a cartridge and a tank according to a second modification to the embodiment are connected to each other.

FIG. 4 depicts an ink cartridge 330 and a tank 303 according to a second modification to the embodiment. In the second modification, the ink cartridge 330 is connected to the tank 303 horizontally, from a front side thereof.

Specifically, the ink cartridge 330 includes a housing 331 defining a storage chamber 332 therein. The housing 331 includes a front wall 341, an upper wall 339, a rear wall 340, a lower wall 342 and a pair of side walls 337. Unlike the embodiment, an ink supply portion 334 is provided at the rear wall 340, rather than at the lower wall 342. The rear wall 340 is formed with an outlet port 333 extending in the front-rear direction 8.

The tank 303 defines a storage chamber 321 therein and is provided with a connecting pipe 307. The tank 303 includes an upper wall 353, a front wall 352 (a first front wall 352A, a second front wall 352B and a third front wall 352C), a rear wall 351, a lower wall 354, step walls 356 and 357, and a pair of side walls 355. The storage chamber 321 includes a first section 361, a second section 362 and a third section 363, as in the embodiment. The connecting pipe 307 of this modification includes a vertical portion 307B extending in the up-down direction 7 and a horizontal portion 307C extending in the front-rear direction 8. The connecting pipe 307 has an opening 309 formed in a front end of the horizontal portion 307C. An internal space 307A of the connecting pipe 307 is in communication with the storage chamber 321 of the tank 303 through an inlet port 326 formed in the step wall 357. The ink cartridge 330 is connected to the horizontal portion 307C of the connecting pipe 307 in the front-rear direction 8. In a state where the ink cartridge 330 is connected to the connecting pipe 307, the storage chamber 332 of the ink cartridge 330 is allowed to communicate with the storage chamber 321 (first section 361) through the opening 309, the internal space 307A and the inlet port 326.

In a case where the connecting pipe 307 includes the vertical portion 307B as in FIG. 4, the predetermined position P1 may be set to a position (height) lower than an upper end P4 of the vertical portion 307B and higher than a lower end P5 of the vertical portion 307B in the up-down direction 7.

Note that, in the configuration illustrated in FIG. 4, a portion of the connecting pipe 307 constitutes the vertical portion 307B. Contrary, in the depicted embodiment (the configuration illustrated in FIG. 2), an entirety of the connecting pipe 107 constitutes a vertical portion.

<Third Modification>

In the embodiment, the predetermined position P1 is located in the second section 162. That is, the liquid-level sensor 55 is configured to detect the level of the ink stored in the second section 162. Accordingly, the prism 55A of the liquid-level sensor 55 of the embodiment and the detection member 255C of the liquid-level sensor 255 of the first modification are both provided in the second section 162, 262. However, the predetermined position P1 may be located in a portion other than the second section 162, and the liquid-level sensor 55 may be configured to detect the liquid level in a portion of the tank 103 other than the second section 162.

Figure 5:
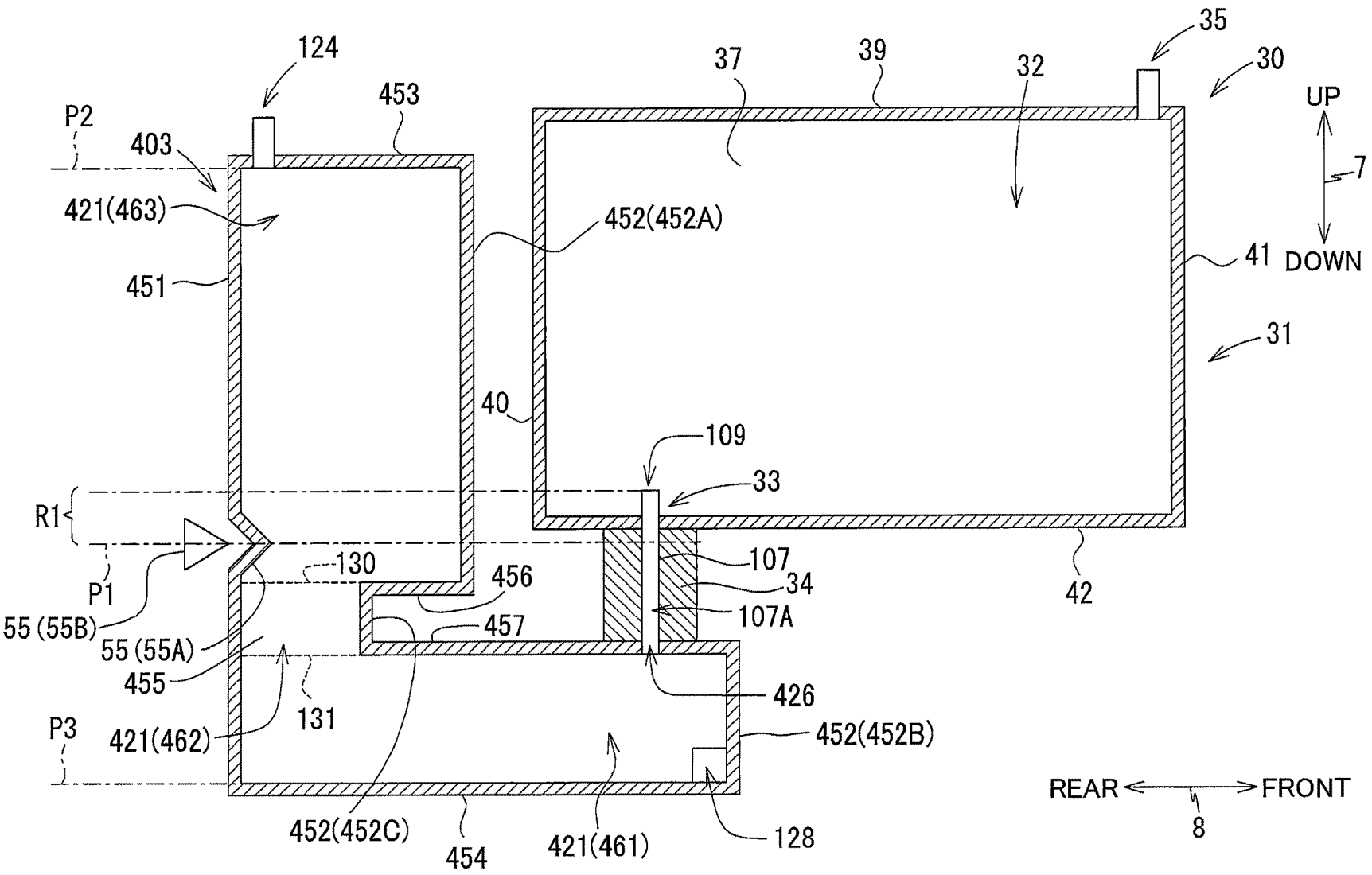
FIG. 5 is a vertical cross-sectional view schematically illustrating a state in which a cartridge and a tank according to a third modification to the embodiment are connected to each other.

For example, FIG. 5 depicts a tank 403 according to a third modification to the embodiment. The tank 403 defines therein a storage chamber 421 configured of a first section 461, a second section 462 and a third section 463. The first section 461 is in communication with the internal space 107A of the connecting pipe 107 through an inlet port 426 formed in a step wall 457 of the tank 403. In the third modification, the predetermined position P1 is located in the third section 463, rather than in the second section 462. The liquid-level sensor 55 is thus configured to detect the level of ink stored in the third section 463.

Specifically, the first section 461 is defined by a second front wall 452B of a front wall 452, a lower wall 454, a rear wall 451, the step wall 457 and a pair of side walls 455. The second section 462 is defined by the rear wall 451, a third front wall 452C of the front wall 452, and the side walls 455. The third section 463 is defined by the rear wall 451, a first front wall 452A of the front wall 452, an upper wall 453, a step wall 456 and the side walls 455. In the tank 403, a lower end of the third section 463 (indicated by the broken line 130) is positioned below the opening 109 of the connecting pipe 107.

<Fourth Modification>

In the depicted embodiment, the inlet port 126 is in communication with the first section 161 of the storage chamber 121. Alternatively, the inlet port 126 may communicate with a portion of the storage chamber 121 other than the first section 161.

Figure 6:
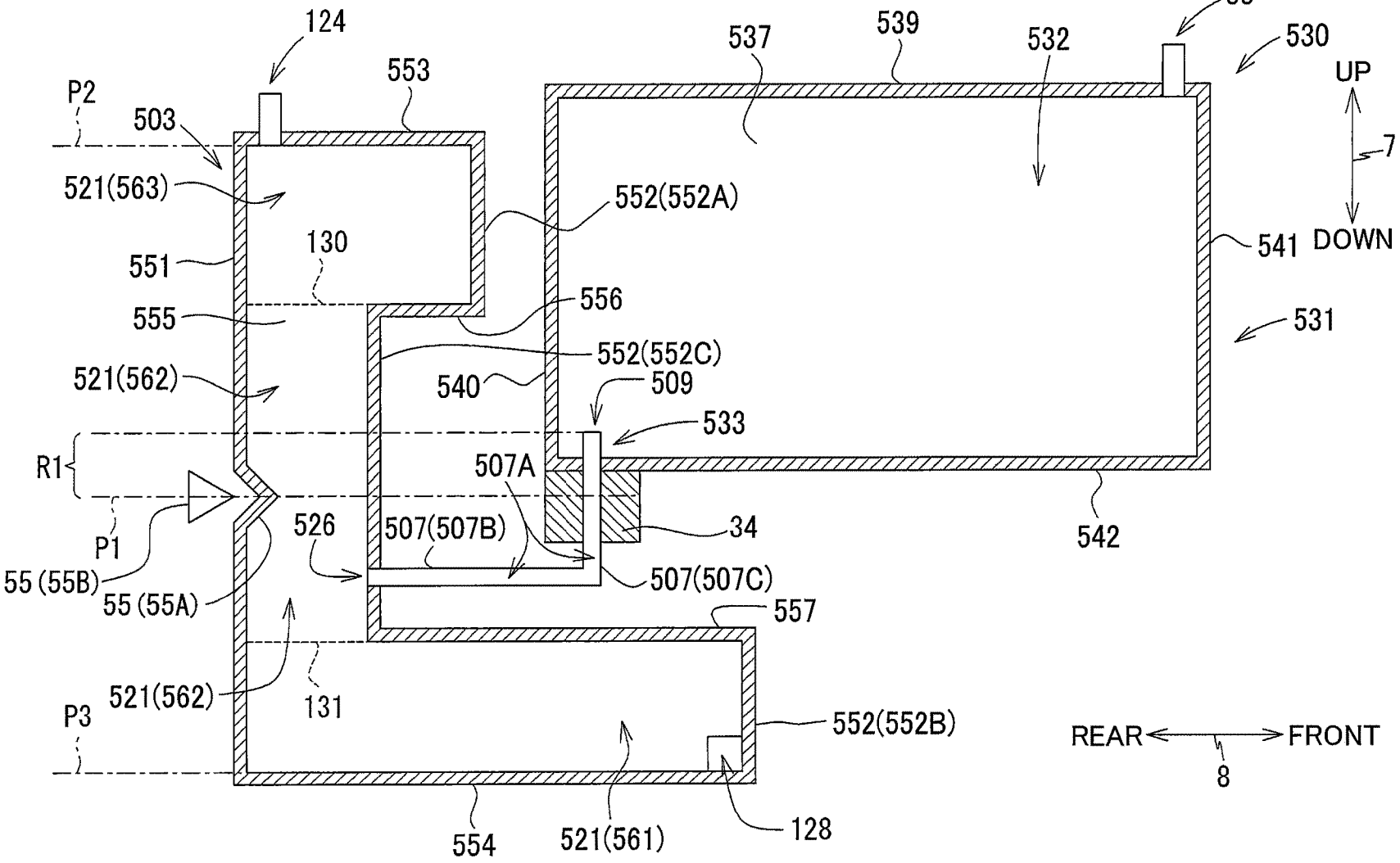
FIG. 6 is a vertical cross-sectional view schematically illustrating a state in which a cartridge and a tank according to a fourth modification to the embodiment are connected to each other.

For example, FIG. 6 illustrates an ink cartridge 530 and a tank 503 according to a fourth modification to the embodiment. The tank 503 defines a storage chamber 521 including a first section 561, a second section 562 and a third section 563, as in the embodiment. However, an inlet port 526 is formed to communicate with the second section 562 of the storage chamber 521.

Specifically, the ink cartridge 530 of the fourth modification includes a housing 531 defining therein a storage chamber 532. The storage chamber 532 is defined by a front wall 541, an upper wall 539, a rear wall 540, a lower wall 542 and side walls 537. The ink supply portion 34 is provided at the lower wall 542 of the housing 531 to communicate with the storage chamber 532 through an outlet port 533 formed in the lower wall 542.

In the tank 503, the first section 561 is defined by a second front wall 552B (front wall 552), a rear wall 551, a step wall 557, a lower wall 554 and a pair of side walls 555. The second section 562 is defined by a third front wall 552C (front wall 552), the rear wall 551, and side walls 555. The inlet port 526 is formed in the third front wall 552C to extend in the front-rear direction 8. The third section 563 is defined by a first front wall 552A (front wall 552), the rear wall 551, an upper wall 553, a step wall 556 and the side walls 555.

The tank 503 includes a connecting pipe 507 that extends from the third front wall 552C defining the second section 562. An internal space 507A of the connecting pipe 507 is in communication with the second section 562 through the inlet port 526. The connecting pipe 507 includes a horizontal portion 507B and a vertical portion 507C, as in the second modification. The vertical portion 507C has an upper end formed with an opening 509. The predetermined position P1 is located below the opening 509 in the up-down direction 7. The ink cartridge 530 is connectable to the vertical portion 507C of the connecting pipe 507 in the up-down direction 7.

<Fifth Modification>

In the depicted embodiment, the horizontal cross-sectional area of the first section 161 is greater than the horizontal cross-sectional area of the second section 162; the horizontal cross-sectional area of the third portion 163 is greater than the horizontal cross-sectional area of the second section 162; and the horizontal cross-sectional area of the first section 161 is greater than the horizontal cross-sectional area of the third portion 163. However, the relationship in size among the horizontal cross-sectional areas of the first section 161, the second section 162, and the third portion 163 is not limited to that of the depicted embodiment.

For example, the horizontal cross-sectional area of the second section 162 may be greater than the horizontal cross-sectional area of the first section 161 or the third portion 163.

<Sixth Modification>

The tank 103 need not include all of the first section 161, the second section 162, and the third portion 163, as illustrated in FIG. 2.

Figure 7B:
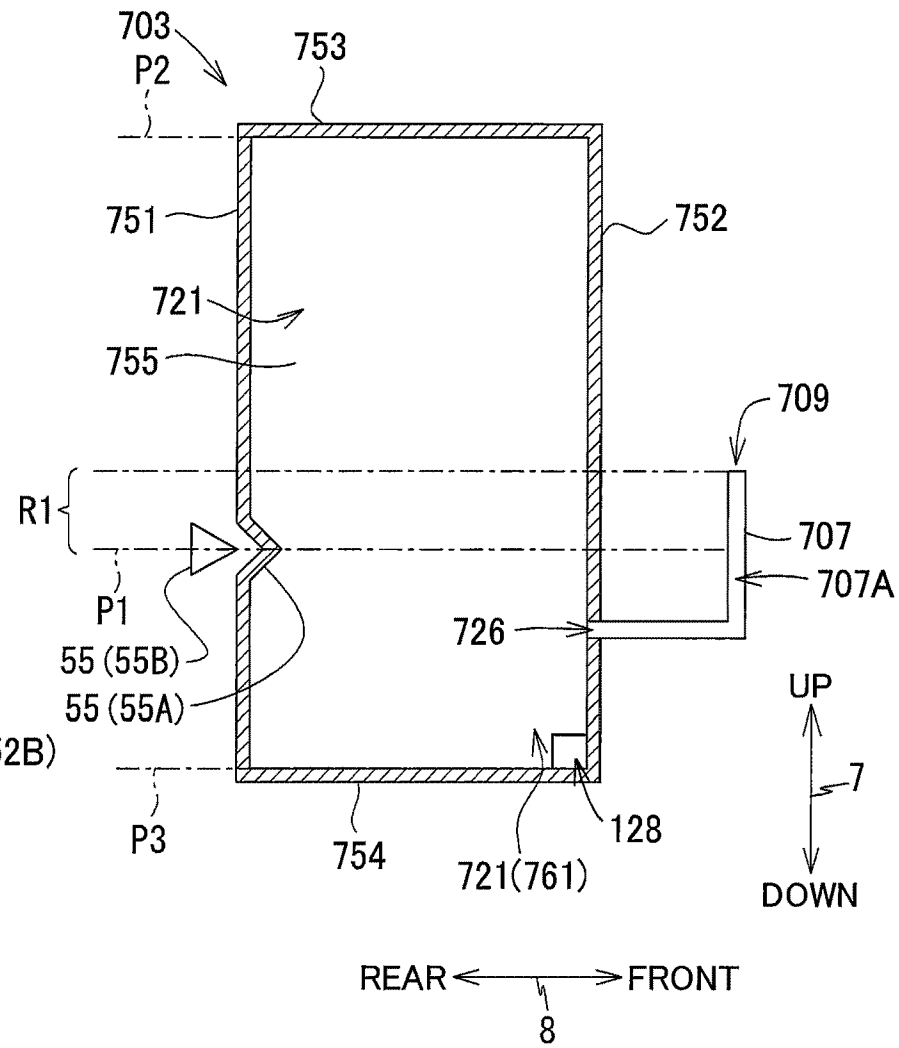
FIG. 7B is a vertical cross-sectional view schematically illustrating a state in which a cartridge and a tank according to a variation of the embodiment are connected to each other.
Figure 7A:
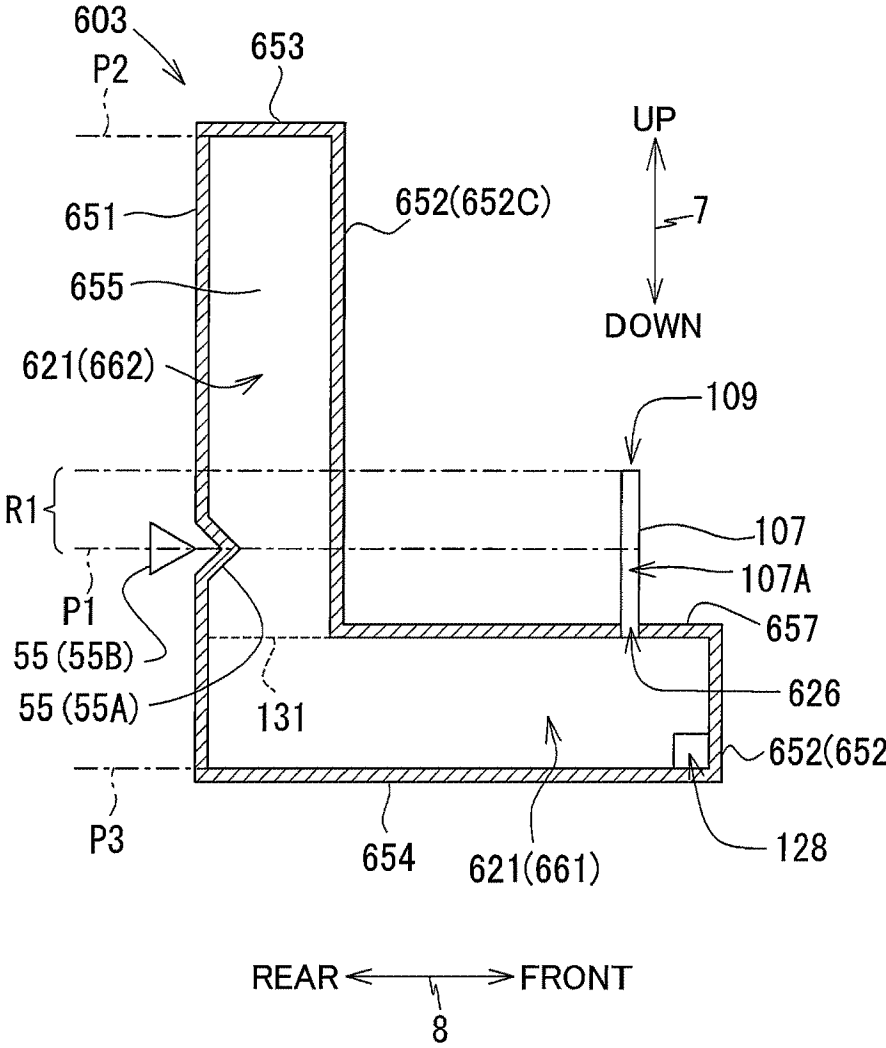
FIG. 7A is a vertical cross-sectional view schematically illustrating a state in which a cartridge and a tank according to a sixth modification to the embodiment are connected to each other.

FIG. 7A depicts a tank 603 according to a sixth modification to the embodiment. The tank 603 defines a storage chamber 621 that includes a first section 661 and a second section 662 only. That is, the tank 603 does not include a portion corresponding to the third section 163 of the embodiment. In the configuration of FIG. 7A, the second section 662 is defined by a rear wall 651, a third front wall 652C of a front wall 652, an upper wall 653, and a pair of side walls 655. The first section 661 is defined by a second front wall 652B of the front wall 652, a lower wall 654, the rear wall 651, a step wall 657, and the side walls 655. The connecting pipe 107 is provided at the step wall 657 so that the internal space 107A of the connecting pipe 107 communicates with the first section 661 through an inlet port 626 formed in the step wall 657.

Alternatively, for example, the tank 103 may have a simple rectangular parallelepiped shape, as illustrated in FIG. 7B.

In a configuration of FIG. 7B, a tank 703 defines a storage chamber 721 therein. The storage chamber 721 is defined by a rear wall 751, an upper wall 753, a front wall 752, a lower wall 754, and a pair of side walls 755. The tank 703 includes a connecting pipe 707 configured of a horizontal portion and a vertical portion. An internal space 707A of the connecting pipe 707 is in communication with the storage chamber 721 through an inlet port 726 formed in the front wall 752. An upper end of the connecting pipe 707 is formed with an opening 709 positioned higher than the predetermined position P1.

<Other Variations>

In the depicted embodiment, the communication opening 124 is formed in the upper wall 153. Alternatively, the communication opening 124 may be formed in one of the walls of the tank 103 other than the upper wall 153. For example, the communication opening 124 may be formed in the first front wall 152A.

In the embodiment, the communication port 35 is formed in the upper wall 39 of the housing 31 of the ink cartridge 30. However, the communication port 35 may be formed in one of the walls of the housing 31 other than the upper wall 39. For example, the communication port 35 may be formed at the front wall 41 of the housing 31.

In the embodiment, ink serves as an example of liquid, and the recording portion 24 is described as an example of a consuming device of the liquid supplying system of the disclosure. However, the liquid supplying system of the present disclosure may also be embodied, for example, as a device with a roller for applying a pretreatment liquid onto a recording sheet prior to ink during an image-recording operation. In this device, the pretreatment liquid may serve as the liquid and the roller serves as the consuming device.

<Remarks>

The multifunction peripheral 10 is an example of a liquid supplying system. The ink cartridges 30, 330, 530 are an example of a cartridge. The ink is an example of liquid. The storage chamber 32, 332, 532 is an example of a first storage chamber. The communication port 35 is an example of a first air communication port. The connecting pipes 107, 307, 507, 707 are an example of a tube. The openings 109, 309, 509, 709 are an example of an opening of the tube. The internal spaces 107A, 307A, 507A, 707A are an example of a liquid passage. The tanks 103, 203, 303, 403, 503, 603, 703 are an example of a tank. The storage chambers 121, 221, 321, 421, 521, 621, 721 are an example of a second storage chamber. The inlet ports 126, 326, 426, 526, 626, 726 are an example of an inlet port. The communication port 124 is an example of a second air communication port. The outlet port 128 is an example of an outlet port. The liquid-level sensors 55, 255 are an example of a detector. The predetermined position P1 is an example of a predetermined position.

What is claimed is:

1. A liquid supplying system comprising:

a cartridge comprising:

a first storage chamber configured to store therein a liquid; and a first air communication port allowing the first storage chamber to communicate with an atmosphere;

a tube to which the cartridge is connectable, the tube having an opening through which the liquid stored in the first storage chamber of the cartridge connected to the tube is introduced, and the tube defining a liquid passage through which the liquid introduced from the first storage chamber through the opening flows;

a tank comprising:

a second storage chamber configured to store the liquid, the second storage chamber having an upper end positioned above the liquid passage and having a lower end positioned below the liquid passage;

an inlet port through which the liquid flowing through liquid passage from the first storage chamber of the cartridge connected to the tube is introduced into the second storage chamber, the opening of the tube being positioned above the inlet port; and a second air communication port allowing the second storage chamber to communicate with the atmosphere; and a detector configured to detect whether a level of the liquid stored in the second storage chamber reaches a predetermined position in a vertical direction, the predetermined position being below the opening and above the inlet port in the vertical direction, wherein the second storage chamber has a horizontal cross-sectional area greater than a horizontal cross-sectional area of the liquid passage in a region above the predetermined position and below the opening in the vertical direction.

2. The liquid supplying system according to claim 1, wherein the tube includes a vertical portion extending in the vertical direction, the vertical portion having an upper end positioned above the predetermined position and having a lower end positioned below the predetermined position in the vertical direction.

3. The liquid supplying system according to claim 1, wherein the second storage chamber comprises:

a first section; and a second section positioned above the first section and having a horizontal cross-sectional area smaller than a horizontal cross-sectional area of the first section;

wherein the inlet port is in communication with the first section; and wherein the detector is configured to detect the level of the liquid stored in the second section.

4. The liquid supplying system according to claim 3, wherein the second storage chamber further comprises a third section positioned above the second section, the third section having a horizontal cross-sectional area greater than the horizontal cross-sectional area of the second section.

5. The liquid supplying system according to claim 1, wherein the detector comprises:

a prism positioned at the predetermined position in the second storage chamber; and a light emitter configured to emit light toward the prism.

6. The liquid supplying system according to claim 1, wherein the detector comprises:

a light emitter configured to emit light, the light emitted from the light emitter providing an optical path; and a detection member provided in the second storage chamber and including a float having a specific gravity lower than a specific gravity of the liquid stored in the second storage chamber, the detection member being movable from a first position to a second position when the level of the liquid stored in the second storage chamber is equal to or lower than the predetermined position in the vertical direction.

7. The liquid supplying system according to claim 6, wherein the detection member at the first position is positioned in the optical path, and the detection member at the second position is positioned offset from the optical path.

8. The liquid supplying system according to claim 1, wherein the tank further comprises an outlet port through which the liquid stored in the second storage chamber is discharged, the outlet port being positioned below the inlet port.

9. The liquid supplying system according to claim 1, wherein the tube extends in the vertical direction; and wherein the cartridge is connectable to the tube in the vertical direction.

10. The liquid supplying system according to claim 1, wherein the tube includes:

a vertical portion extending in the vertical direction; and a horizontal portion extending in a horizontal direction from an upper end of the vertical portion, the horizontal portion defining the opening; and wherein the cartridge is connectable to the horizontal portion of the tube in the horizontal direction.

* * * * *